US009024853B2

(12) United States Patent
Yu et al.

(10) Patent No.: US 9,024,853 B2
(45) Date of Patent: May 5, 2015

(54) LIQUID CRYSTAL DISPLAY DRIVE CIRCUIT

(71) Applicant: Shenzhen China Star Optoelectronics Technology Co., Ltd., Shenzhen, Guangdong (CN)

(72) Inventors: Gang Yu, Shenzhen (CN); Yubo Gu, Shenzhen (CN); Pei Jia, Shenzhen (CN); Liuyang Yang, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 79 days.

(21) Appl. No.: 13/805,663

(22) PCT Filed: Nov. 8, 2012

(86) PCT No.: PCT/CN2012/084259

§ 371 (c)(1),
(2) Date: Dec. 20, 2012

(87) PCT Pub. No.: WO2014/063390

PCT Pub. Date: May 1, 2014

(65) Prior Publication Data

US 2014/0118238 A1 May 1, 2014

(30) Foreign Application Priority Data

Oct. 26, 2012 (CN) ..... 2012 1 0417298

(51) Int. Cl.
*G09G 3/36* (2006.01)

(52) U.S. Cl.
CPC ..... *G09G 3/36* (2013.01); *G09G 3/3648* (2013.01); *G09G 2320/0252* (2013.01)

(58) Field of Classification Search
CPC ..... G09G 3/36; G09G 3/3648
USPC ..... 345/87–93
See application file for complete search history.

(56) References Cited

U.S. PATENT DOCUMENTS 4,851,827 A * 7/1989 Nicholas ..... 345/93
5,844,535 A * 12/1998 Itoh et al. ..... 345/92
6,633,306 B1 * 10/2003 Marz et al. ..... 345/698

(Continued)

FOREIGN PATENT DOCUMENTS

CN 1627353 A 6/2005
CN 101206321 A 6/2008

(Continued)

*Primary Examiner* — Matthew Fry
(74) *Attorney, Agent, or Firm* — Andrew C. Cheng

(57) ABSTRACT

The present invention provides a liquid crystal device drive circuit, which includes a gate driver, a source driver, a plurality of gate lines, and a plurality of data lines. The gate lines and data lines define a plurality of pixel units. Each pixel unit includes a thin-film transistor, a common electrode, a pixel electrode electrically connected to the thin-film transistor, a storage capacitor, and a timer switch. The pixel electrode is electrically connected to the thin-film transistor. The common electrode and the pixel electrode constitute a liquid crystal capacitor. The storage capacitor is connected in parallel to the liquid crystal capacitor. The thin-film transistor includes a gate terminal and a source terminal. The gate terminal is electrically connected to the gate line via the timer switch. The thin-film transistor is electrically connected to the gate driver and the source driver respectively by the gate lines and the data lines.

6 Claims, 6 Drawing Sheets

(56) References Cited

U.S. PATENT DOCUMENTS

| | | | | |
|---|---|---|---|---|
| 6,727,875 | B1 * | 4/2004 | Mikami et al. | 345/92 |
| 6,825,822 | B2 * | 11/2004 | Lee | 345/87 |
| 7,002,542 | B2 * | 2/2006 | Lee | 345/94 |
| 8,154,528 | B2 * | 4/2012 | Chen et al. | 345/173 |
| 2004/0041763 | A1 * | 3/2004 | Kodama et al. | 345/87 |
| 2005/0248550 | A1 * | 11/2005 | Kobayashi et al. | 345/204 |
| 2009/0046085 | A1 * | 2/2009 | Ino et al. | 345/208 |
| 2009/0195532 | A1 * | 8/2009 | Jang | 345/213 |
| 2011/0063260 | A1 | 3/2011 | Wang et al. | |
| 2011/0128265 | A1 * | 6/2011 | Marhefka et al. | 345/211 |
| 2014/0111721 | A1 * | 4/2014 | Chen et al. | 349/43 |
| 2014/0111722 | A1 * | 4/2014 | Chen et al. | 349/43 |

FOREIGN PATENT DOCUMENTS

| | | | |
|---|---|---|---|
| CN | 102402085 | A | 4/2012 |
| CN | 202394020 | U | 8/2012 |
| JP | 2000147467 | A | 5/2000 |
| JP | 2001005037 | A | 1/2011 |

* cited by examiner

LIQUID CRYSTAL DISPLAY DRIVE CIRCUIT

BACKGROUND OF THE INVENTION

1. Field of the Invention

The present invention relates to the field of liquid crystal displaying, and in particular to a liquid crystal display drive circuit.

2. The Related Arts

The progress of science and technology and the improvement of living quality of human beings makes liquid crystal display devices widely used everywhere in daily living. People are now asking for more for the liquid crystal display devices and start demanding large display screen and fast response. However, increasing the size of the liquid crystal display brings more complicated wire lay-out. Also, accurately controlling pixel electrodes is getting more difficult due to wiring delay caused by the increase of number of pixel electrodes driven by a TFT (Thin-Film Transistor) substrate and feedback caused by the existence of TFT parasitic capacitor.

Referring to FIGS. 1 and 2, FIG. 1 is a schematic view showing the structure of a basic drive circuit of a TFT array substrate. In the drawing, pixel electrodes 100 are shown distributed in the entire TFT array substrate and each pixel electrode 100 is connected to a drain terminal d of at least one TFT. The source terminal s of each TFT is connected to at least one data line and a plurality data lines collectively constitutes a data bus structure. The gate terminal g of each TFT is connected to at least one gate line and a plurality of gate lines collectively constitutes a gate bus structure. The data bus and the gate bus collectively control data writing of the pixel electrodes via the thin-film transistors. The pixel electrode 100 of the ith column and jth row of the TFT array substrate is commonly controlled by the gate line G(j) and data line S(i). When a writing operation is performed on the pixel electrode P'(i,j), the gate line G(j) is set at a high level to set the thin-film transistor T(i,j) in a conducting state. Under this condition, the magnitude of the drive voltage applied through the data line S(i) causes the liquid crystal molecules neighboring a site opposing the pixel electrode 100 to rotate according to a predetermined rotation direction so as to achieve displaying of image. Such a writing operation is performed in row-wise manner, so that when the gate line G(j) is in the high level, all the pixel electrodes of the jth row can perform a writing operation.

Referring to FIG. 2, which is a schematic view showing connection of an equivalent drive circuit of each pixel electrode, the ith data line S(i) is connected to the source terminal s of the thin-film transistor T(i,j) at the ith column and jth row. The jth gate line G(j) is connected to the gate terminal g of the thin-film transistor T(i,j) at the ith column and jth row. The drain terminal d of the thin-film transistor T(i,j) at the ith column and jth row is connected to the pixel electrode 100 at the ith column and jth row. The symbol $C_{gd}$ indicates a parasitic capacitor between the gate terminal g and the drain terminal d. The parasitic capacitor $C_{gd}$ is inherent to the characteristics of the thin-film transistors. The symbol $C_{lc}$ indicates an equivalent capacitor of a liquid crystal layer between the TFT substrate and a CF (Color Filter) substrate and $C_s$ is a compensation capacitor between the TFT substrate and Vcom. The compensation capacitor $C_s$ is provided for compensating for voltage drop of the equivalent liquid crystal capacitor $C_{lc}$ through electrical discharging in order to properly extend the retention time for direction change of liquid crystal molecules in the area of the equivalent liquid crystal capacitor $C_{lc}$. However, with the increase of the numbers of rows and columns of the pixel electrodes distributed in a matrix form on a TFT array substrate, the lengthened gate lines and data lines cause time delay in the drive circuit. As shown in FIG. 3, on the other hand, the parasitic capacitor $C_{gd}$ existing between the gate terminal g and the drain terminal d of a thin-film transistor directly affects the gate voltage $V_g$ controlling conduction and cutoff of the thin-film transistor, especially for the neighboring site of the pixel electrode that is located at a distal end away from the data bus circuit, where due to the influence of discharging voltage caused by the parasitic capacitors $C_{gd}$ of the previous (n−1) thin-film transistors that the gate signal passed first and the influence caused by circuit delay, this site may have an extended response time and also suffers attenuation of gate voltage caused by the electrical discharging when the gate voltage goes from high to low, making the conduction time of the thin-film transistor T(n,j) extended from $T_j$ by $\Delta T_j$. In other words, the thin-film transistor that is supposed to be cut off is abnormally conducted on. This makes the driving time of the pixel electrode P(n,j) connected to the drain terminal d of the thin-film transistor extended by $\Delta T_{dx}$, leading to abnormal rotation of the liquid crystal molecules neighboring the pixel electrode, which causes variation of transmittance and abnormality of contrast.

SUMMARY OF THE INVENTION

An object of the present invention is to provide a liquid crystal device drive circuit, which reduces the influence of time extension caused by parasitic capacitors and improves quality of large-sized liquid crystal display device using the circuit.

To achieve the object, the present invention provides a liquid crystal device drive circuit, which comprises a gate driver, a source driver, a plurality of gate lines, and a plurality of data lines. The plurality of gate lines and data lines define a plurality of pixel units. Each of the pixel units comprises a thin-film transistor, a common electrode, a pixel electrode electrically connected to the thin-film transistor, a storage capacitor, and a timer switch. The pixel electrode is electrically connected to the thin-film transistor. The common electrode and the pixel electrode constitute a liquid crystal capacitor. The storage capacitor is connected in parallel to the liquid crystal capacitor. The thin-film transistor comprises a gate terminal and a source terminal. The gate terminal is electrically connected to the gate line via the timer switch. The thin-film transistor is electrically connected to the gate driver and the source driver respectively by means of the gate lines and the data lines.

The plurality of gate lines and the plurality of data lines are arranged to intersect each other and are electrically connected, at the intersections, to the pixel units via the thin-film transistors.

The gate lines comprise a rectangular gate signal. The gate signal controls conduction or cutoff of the thin-film transistors. The rectangular gate signal comprises a plurality of high levels and a plurality of low levels. The plurality of high levels and the plurality of low levels are arranged in a random manner. Each of the high levels comprises first and second time intervals.

The timer switch is closed in the first time interval and is open in the second time interval.

The thin-film transistor comprises a drain terminal. The pixel electrode is electrically connected to the drain terminal.

The gate terminal and drain terminal of the thin-film transistor form a parasitic capacitor due to structural characteristics thereof. A discharging time that the parasitic capacitor, after having been fully charged, needs to discharge to such a condition that voltage across two ends thereof is substantially equal to a threshold voltage of the thin-film transistor is defined as a third time interval.

The second time interval is substantially equal to the third time interval.

The timer switch comprises an electrical switch and a timer. The electrical switch comprises first, second, and third pins. The timer has an end electrically connected to the gate line and another end electrically connected to the second pin. The first pin is electrically connected to the gate line. The third pin is electrically connected to the gate terminal of the thin-film transistor.

The timer triggers the electrical switch to open or close.

The present invention also provides a liquid crystal device drive circuit, which comprises a gate driver, a source driver, a plurality of gate lines, and a plurality of data lines, the plurality of gate lines and data lines define a plurality of pixel units, each of the pixel units comprising a thin-film transistor, a common electrode, a pixel electrode electrically connected to the thin-film transistor, a storage capacitor, and a timer switch, the pixel electrode being electrically connected to the thin-film transistor, the common electrode and the pixel electrode constituting a liquid crystal capacitor, the storage capacitor being connected in parallel to the liquid crystal capacitor, the thin-film transistor comprising a gate terminal and a source terminal, the gate terminal being electrically connected to the gate line via the timer switch, the thin-film transistor being electrically connected to the gate driver and the source driver respectively by means of the gate lines and the data lines;

wherein plurality of gate lines and the plurality of data lines are arranged to intersect each other and are electrically connected, at the intersections, to the pixel units via the thin-film transistors;

wherein the gate lines comprise a rectangular gate signal, the gate signal controlling conduction or cutoff of the thin-film transistors, the rectangular gate signal comprising a plurality of high levels and a plurality of low levels, the plurality of high levels and the plurality of low levels being arranged in a random manner, each of the high levels comprising first and second time intervals;

wherein, the timer switch is closed in the first time interval and is open in the second time interval;

wherein the thin-film transistor comprises a drain terminal, the pixel electrode being electrically connected to the drain terminal;

wherein the gate terminal and drain terminal of the thin-film transistor form a parasitic capacitor due to structural characteristics thereof, a discharging time that the parasitic capacitor, after having been fully charged, needs to discharge to such a condition that voltage across two ends thereof is substantially equal to a threshold voltage of the thin-film transistor being defined as a third time interval;

wherein the second time interval is substantially equal to the third time interval;

wherein the timer switch comprises an electrical switch and a timer, the electrical switch comprising first, second, and third pins, the timer having an end electrically connected to the gate line and another end electrically connected to the second pin, the first pin being electrically connected to the gate line, the third pin being electrically connected to the gate terminal of the thin-film transistor; and wherein the timer triggers the electrical switch to open or close.

The efficacy of the present invention is that the present invention provides a liquid crystal display drive circuit, which comprises a timer switch that has a function of switching serially connected to a gate terminal of a thin-film transistor in order to early cut off a gate signal at a high level and to use the electrical discharging of a parasitic capacitor to accomplish driving thereby reducing the influence of discharging voltage of the parasitic capacitor on the extension of conduction time of the gate terminal to thereby avoid the occurrence of the situation that a thin-film transistor that is supposed to cut off is abnormally conducted on and to further improve the accuracy of controlling the thin-film transistor, eliminating variation of transmittance and abnormal contrast caused by abnormal rotation of liquid crystal molecules, and improving the quality of a large-sized liquid crystal display device using the circuit.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, of the present invention will be apparent from the following detailed description of an embodiment of the present invention, with reference to the attached drawings. In the drawings.

DETAILED DESCRIPTION OF THE PREFERRED EMBODIMENTS

To further expound the technical solution adopted in the present invention and the advantages thereof, a detailed description is given to a preferred embodiment of the present invention and the attached drawings.

Figure 4:
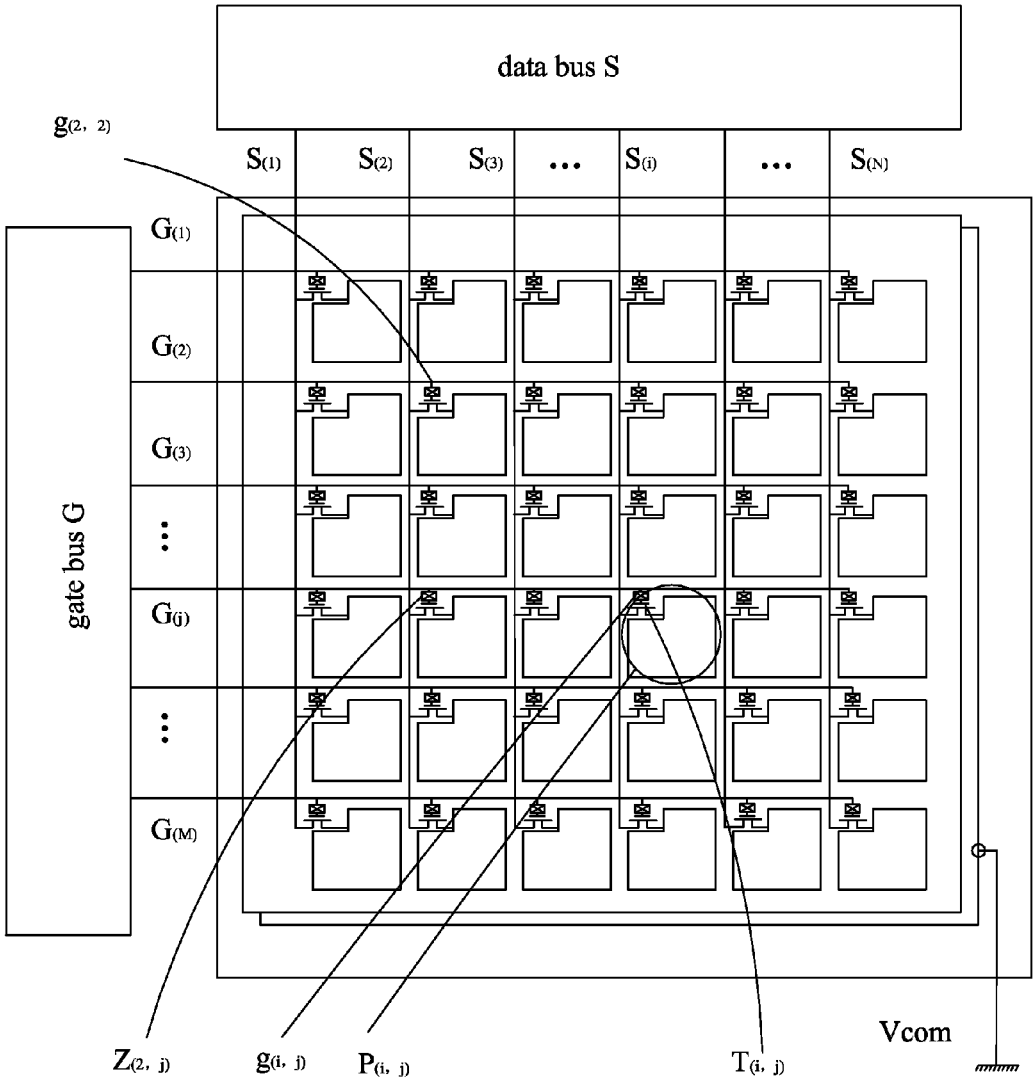
FIG. 4 is a schematic view showing a circuit structure of application of the liquid crystal display drive circuit according to the present invention to a TFT array substrate.
Figure 5:
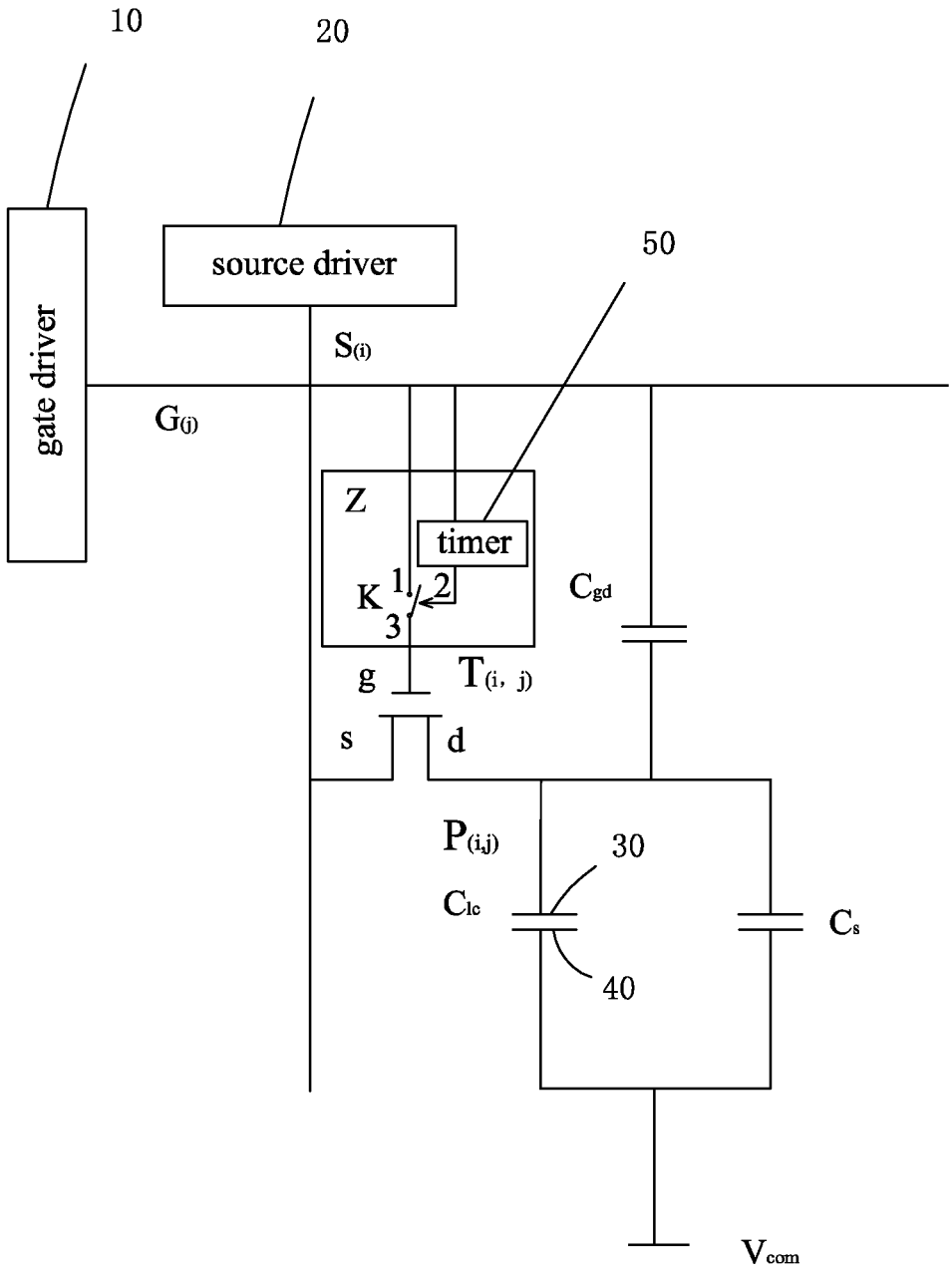
FIG. 5 is a schematic view showing connection of a drive circuit of a pixel unit in a liquid crystal display drive circuit according to the present invention.
Figure 6:
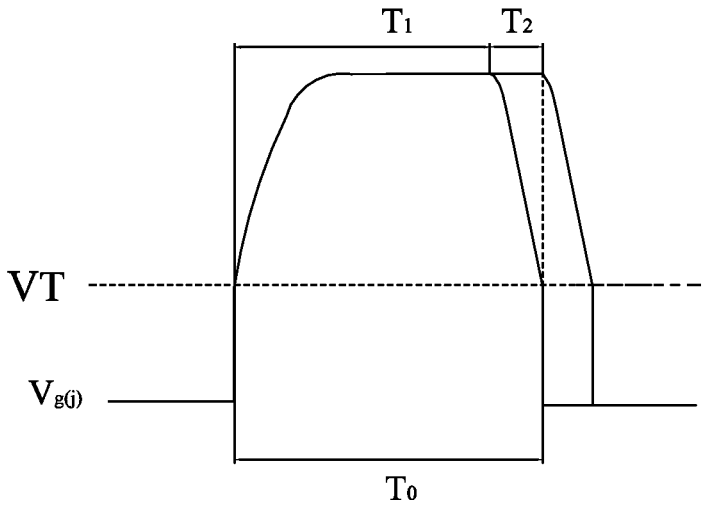
FIG. 6 shows waveform of drive voltage of a gate terminal of thin-film transistor in the liquid crystal display drive circuit according to the present invention.

Referring to FIGS. 4-6, the present invention provides a liquid crystal device drive circuit, which comprises a gate driver 10, a source driver 20, a plurality of gate lines G(j), and a plurality of data lines S(i). The plurality of gate lines G(j) and data lines S(i) define a plurality of pixel units P(i,j). Each of the pixel units P(i,j) comprises a thin-film transistor T(i,j), a common electrode 40, a pixel electrode 30 electrically connected to the thin-film transistor T(i,j), a storage capacitor $C_s$, and a timer switch Z. The pixel electrode 30 is electrically connected to the thin-film transistor T(l,j). The common electrode 40 and the pixel electrode 30 constitute a liquid crystal capacitor $C_{lc}$. The gate driver 10 and the source driver 20 form a drive voltage on the liquid crystal capacitor $C_{1c}$ via the thin-film transistor T(i,j) to drive liquid crystal molecules to rotate for displaying an image. The storage capacitor $C_s$ is connected in parallel to the liquid crystal capacitor $C_{lc}$. The thin-film transistor T(i,j) comprises a gate terminal g and a source terminal s. The gate terminal g is electrically connected to the gate line G(j) via the timer switch Z. The thin-film transistor T(i,j) is electrically connected to the gate driver 10 and the source driver 20 respectively by means of the gate line G(j) and the data line S(i).

The plurality of data lines S(1), S(2), . . . , and S(i) constitutes a data bus structure S. The plurality of gate lines G(1), G(2), . . . , and G(j) constitutes a gate bus structure G. The plurality of gate lines G(j) and the plurality of data lines S(i) are arranged to intersect each other and are electrically connected, at the intersections, to the pixel units P(i,j) via the thin-film transistors T(i,j).

The gate lines G(j) comprise a rectangular gate signal Vg(j). The gate signal controls the conduction or cutoff of the thin-film transistors T(i,j). The rectangular gate signal Vg(j) comprises: a plurality of high levels and a plurality of low levels. The thin-film transistors T(i,j) is conducted on by the plurality of high levels and is cut off under the plurality of low levels. In the instant embodiment, the plurality of high levels is preferably of substantially identical phase. The plurality of high levels and the plurality of low levels are arranged in a random manner. Each high level comprises: first and second time intervals T1, T2. The second time interval T2 is determined according to the discharging time of the parasitic capacitor $C_{gd}$ that is formed by the gate terminal g and a drain terminal d of the thin-film transistor T(i,j) due to the structural characteristics thereof. The first time interval T1 is obtained by subtracting the second time interval T2 from the persistent time interval T0 of the high level of the rectangular gate signal Vg(j). The timer switch Z is closed in the first time interval T1 and is open in the second time interval T2. When the thin-film transistor T(i,j) is in the state that the rectangular gate signal Vg(j) of the gate line G(j) is low level, the timer switch Z can be closed or open, and is preferably open in the instant preferred embodiment to reduce the complication of a control circuit to some extents.

The timer switch Z comprises an electrical switch K and a timer 50. The electrical switch K comprises first, second, and third pins 1, 2, 3. The timer 50 has an end electrically connected to the gate line G(j) and another end electrically connected to the second pin 2. The first pin 1 is electrically connected to the gate line G(j). The third pin 3 is electrically connected to the gate terminal g of the thin-film transistor T(i,j). The timer 50 stores therein the first time interval T1, whereby when the rectangular gate signal Vg(j) of the gate line G(j) changes from the low level to the high level, the timer 50 is activated to start timing and also triggering the electrical switch K to close. When the timing operation of the timer 50 reaches the ending time of the first time interval T1, the electrical switch K is triggered to open and maintaining the open state to the instance that the rectangular gate signal Vg(j) of the next gate line G(j) changes from the low level to the high level. In other words, when the rectangular gate signal Vg(j) of the gate line G(j) changes from high level to low level, both the timer 50 and the electrical switch K do not respond, meaning the timer 50 does not proceed with timing operation and the electrical switch K maintains open state.

Figure 1:
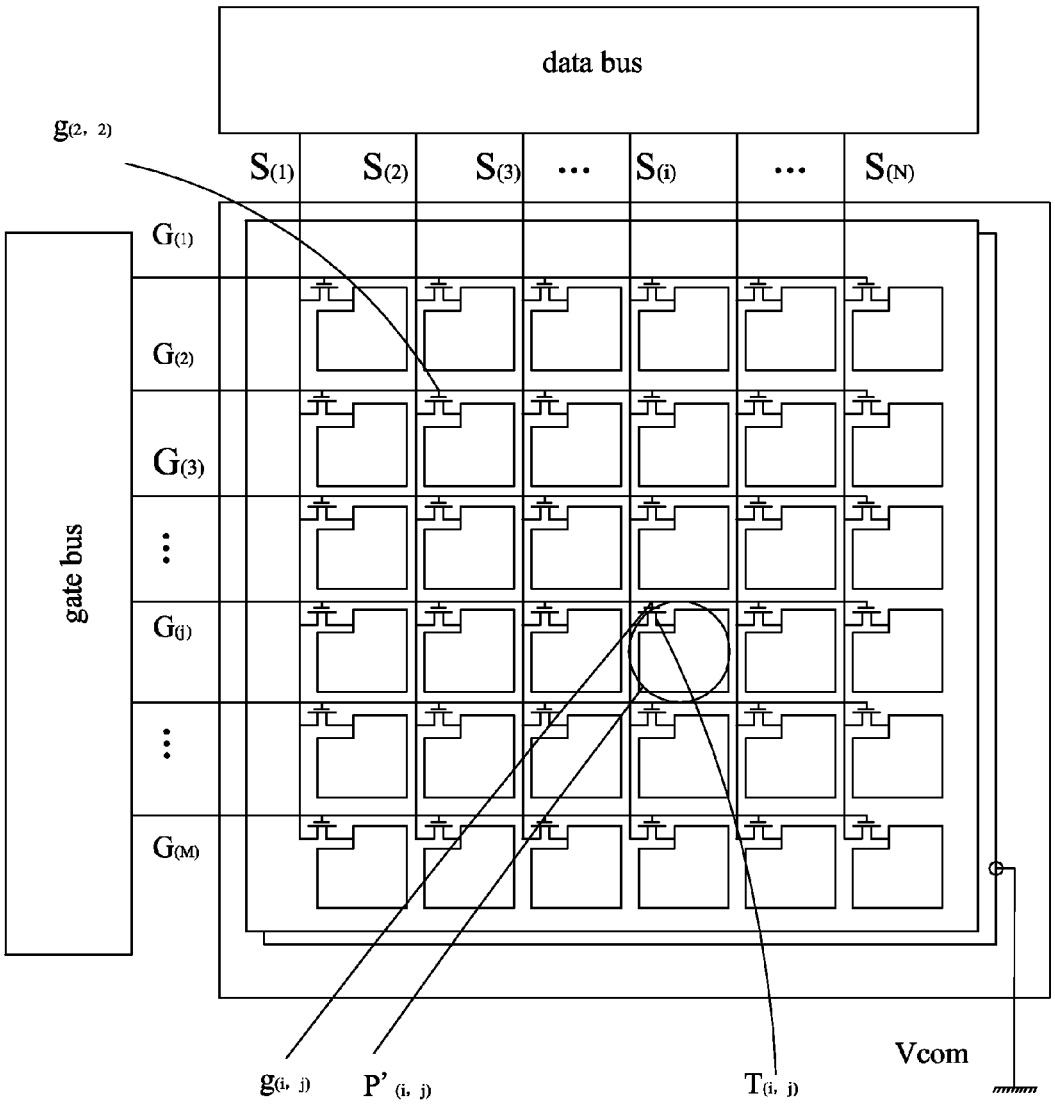
Fig. 1 (Prior Art)
FIG. 1 is a schematic view showing the structure of a drive circuit of TFT array substrate.
Figure 2:
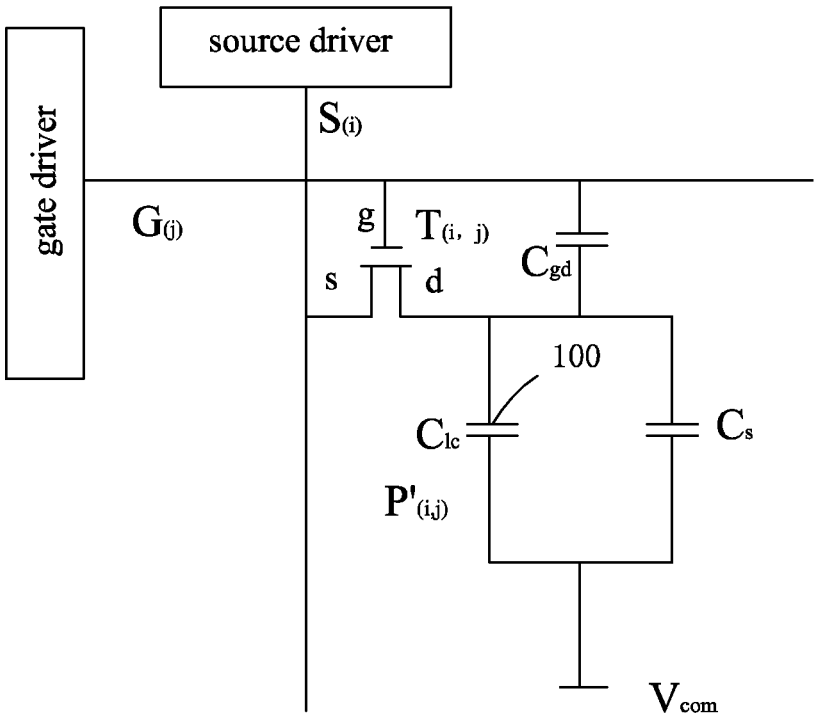
Fig. 2 (Prior Art)
FIG. 2 is a schematic view showing equivalent connection of a drive circuit of a pixel unit.
Figure 3:
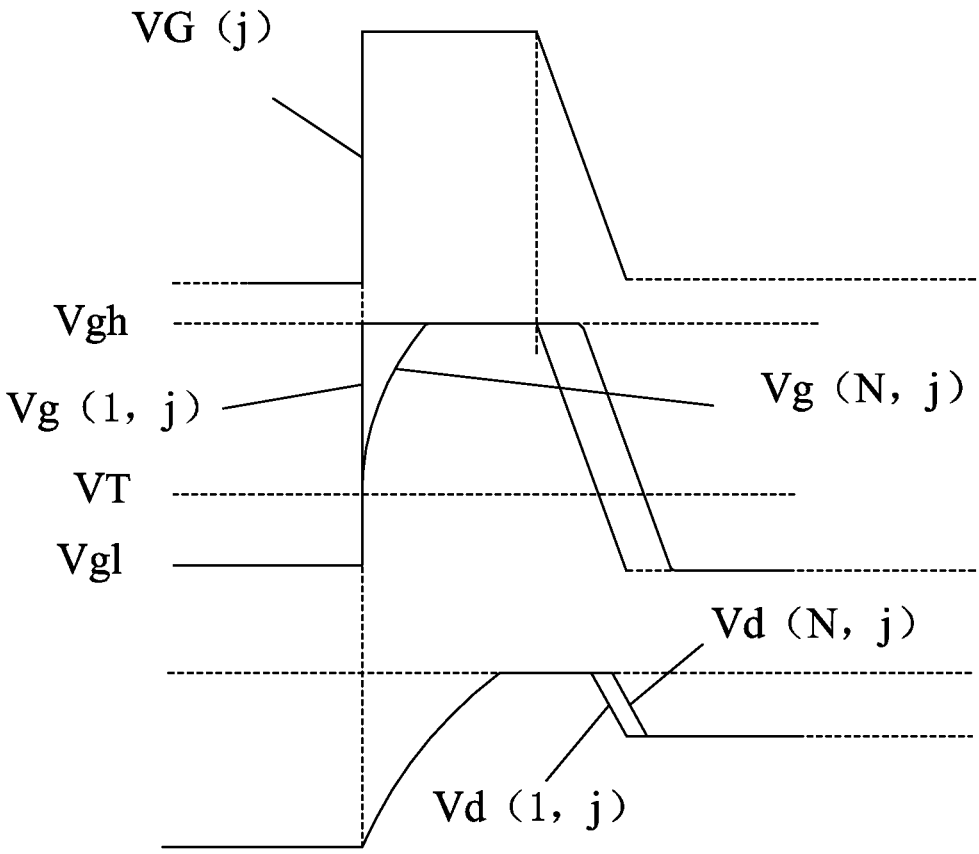
Fig. 3 (Prior Art)
FIG. 3 shows waveform of gate drive voltage induced by a parasitic capacitor.

The thin-film transistor T(i,j) further comprises a drain terminal d. The pixel electrode 30 is electrically connected to the drain terminal d. The gate terminal g and drain terminal d of the thin-film transistor T(i,j) form a parasitic capacitor $C_{gd}$ due to the structural characteristics thereof. The discharging time that the parasitic capacitor $C_{gd}$, after having been charged, needs to discharge to such a condition that the voltage across two ends thereof is substantially equal to the threshold voltage VT of the thin-film transistor T(i,j) is referred to third time interval t. The third time interval t is equal to the second time interval T2. Referring to FIGS. 1-3, the second/third time interval T2/t can be determined according to the following experimental measurement: In a conventional liquid crystal display driving, a high level is continuously applied to the data line S(i) (namely performing a writing operation) and a high voltage is applied to the gate line G(j). After the thin-film transistor T'(i,j) is conducted on, the gate line G(j) is open and timing operation starts. The voltage of the drain terminal d of the thin-film transistor T'(i,j) is inspected. When the voltage of the drain terminal g is zero, the timing operation is stopped and the time is recorded. The time so recorded is the time Δt1 that the parasitic capacitor of the thin-film transistor T'(i,j) of the pixel electrode P'(i,j) needs to discharge to the level of the threshold voltage VT of the thin-film transistor T'(i,j), so that the second/third time interval is determined to be Δt1. The remaining pixel electrodes can be measured in this way to determine the time Δt that the parasitic capacitor $C_{gd}$ of the thin-film transistor needs to discharge to the level of the threshold voltage VT of the thin-film transistors. The timer of each pixel electrode may trigger the electrical switch K and time when it is open can be used to determine the measured time Δt according to the above method.

As shown in FIG. 6, by operating the timer 50 of the timer switch Z to early cut off the high level drive voltage of the gate terminal g of the thin-film transistor T(i,j) and by using the parasitic capacitor Cgd generated between the gate terminal g and the drain terminal d of the thin-film transistor T(i,j) due to the structural characteristics thereof to drive the liquid crystal molecules to rotate, the phenomenon of time extension of conduction of the thin-film transistor T(i,j) caused by the discharging voltage of the parasitic capacitor Cgd can be avoided. In this way, even the size of a liquid crystal display device is made even bigger, it is possible to ensure control accuracy of the thin-film transistor T(i,j) and ensure the quality of displaying.

In summary, the present invention provides a liquid crystal display drive circuit, which comprises a timer switch that has a function of switching serially connected to a gate terminal of a thin-film transistor in order to early cut off a gate signal at a high level and to use the electrical discharging of a parasitic capacitor to accomplish driving thereby reducing the influence of discharging voltage of the parasitic capacitor on the extension of conduction time of the gate terminal to thereby avoid the occurrence of the situation that a thin-film transistor that is supposed to cut off is abnormally conducted on and to further improve the accuracy of controlling the thin-film transistor, eliminating variation of transmittance and abnormal contrast caused by abnormal rotation of liquid crystal molecules, and improving the quality of a large-sized liquid crystal display device using the circuit.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A liquid crystal device drive circuit, comprising a gate driver, a source driver, a plurality of gate lines, and a plurality of data lines, the plurality of gate lines and data lines defining a plurality of pixel units, each of the pixel units comprising a thin-film transistor, a common electrode, a pixel electrode electrically connected to the thin-film transistor, a storage capacitor, and a timer switch, the pixel electrode being electrically connected to the thin-film transistor, the common electrode and the pixel electrode constituting a liquid crystal capacitor, the storage capacitor being connected in parallel to the liquid crystal capacitor, the thin-film transistor comprising a gate terminal and a source terminal, the gate terminal being electrically connected to the gate line via the timer switch, the thin-film transistor being electrically connected to the gate driver and the source driver respectively by means of the gate lines and the data lines;

wherein the timer switch comprises an electrical switch and a timer, the electrical switch comprising first, second, and third pins, the timer having an end electrically connected to the gate line to receive a signal from the gate line for activation of the timer and another end electrically connected to the second pin to apply a signal to set and maintain the electrical switch in a closed condition for a predetermined period of time, the first pin being electrically connected to the gate line, the third pin being electrically connected to the gate terminal of the thin-film transistor; and wherein the gate lines comprise a rectangular gate signal, the gate rectangular signal controlling conduction or cutoff of the thin-film transistors, the rectangular gate signal comprising a plurality of high levels and a plurality of low levels, the plurality of high levels and the plurality of low levels being arranged in a predetermined manner, each of the high levels comprising first and second time intervals, which are supplied to each of the timer switches to allow the timer switch to be closed in the first time interval and open in the second time interval, where the first and second time intervals of each of the timer switches are determined individually and thus different for each of the timer switches.

2. The liquid crystal device drive circuit as claimed in claim 1, wherein the plurality of gate lines and the plurality of data lines are arranged to intersect each other and are electrically connected, at the intersections, to the pixel units via the thin-film transistors.

3. The liquid crystal device drive circuit as claimed in claim 1, wherein the thin-film transistor comprises a drain terminal, the pixel electrode being electrically connected to the drain terminal.

4. The liquid crystal device drive circuit as claimed in claim 3, wherein the gate terminal and drain terminal of the thin-film transistor form a parasitic capacitor due to structural characteristics thereof, a discharging time that the parasitic capacitor, after having been fully charged, needs to discharge to such a condition that voltage across two ends thereof is substantially equal to a threshold voltage of the thin-film transistor being defined as a third time interval.

5. The liquid crystal device drive circuit as claimed in claim 4, wherein the second time interval is substantially equal to the third time interval.

6. A liquid crystal device drive circuit, comprising a gate driver, a source driver, a plurality of gate lines, and a plurality of data lines, the plurality of gate lines and data lines defining a plurality of pixel units, each of the pixel units comprising a thin-film transistor, a common electrode, a pixel electrode electrically connected to the thin-film transistor, a storage capacitor, and a timer switch, the pixel electrode being electrically connected to the thin-film transistor, the common electrode and the pixel electrode constituting a liquid crystal capacitor, the storage capacitor being connected in parallel to the liquid crystal capacitor, the thin-film transistor comprising a gate terminal and a source terminal, the gate terminal being electrically connected to the gate line via the timer switch, the thin-film transistor being electrically connected to the gate driver and the source driver respectively by means of the gate lines and the data lines;

wherein the gate lines comprise a rectangular gate signal, the gate rectangular signal controlling conduction or cutoff of the thin-film transistors, the rectangular gate signal comprising a plurality of high levels and a plurality of low levels, the plurality of high levels and the plurality of low levels being arranged in a predetermined manner, each of the high levels comprising first and second time intervals, which are supplied to each of the timer switches to allow the timer switch to be closed in the first time interval and open in the second time interval, where the first and second time intervals of each of the timer switches are determined individually and thus different for each of the timer switches;

wherein the plurality of gate lines and the plurality of data lines are arranged to intersect each other and are electrically connected, at the intersections, to the pixel units via the thin-film transistors;

wherein the thin-film transistor comprises a drain terminal, the pixel electrode being electrically connected to the drain terminal;

wherein the gate terminal and drain terminal of the thin-film transistor form a parasitic capacitor due to structural characteristics thereof, a discharging time that the parasitic capacitor, after having been fully charged, needs to discharge to such a condition that voltage across two ends thereof is substantially equal to a threshold voltage of the thin-film transistor being defined as a third time interval;

wherein the second time interval is substantially equal to the third time interval;

wherein the timer switch comprises an electrical switch and a timer, the electrical switch comprising first, second, and third pins, the timer having an end electrically connected to the gate line to receive a signal from the gate line for activation of the timer and another end electrically connected to the second pin to apply a signal to set and maintain the electrical switch in a closed condition for a predetermined period of time, the first pin being electrically connected to the gate line, the third pin being electrically connected to the gate terminal of the thin-film transistor.

* * * * *